US008876251B2

(12) United States Patent
Sugimoto et al.

(10) Patent No.: US 8,876,251 B2
(45) **Date of Patent: *Nov. 4, 2014**

(54) RECORDING APPARATUS

(75) Inventors: Masahiro Sugimoto, Yokohama (JP); Akira Kida, Yokohama (JP); Susumu Hirosawa, Tokyo (JP); Takeaki Nakano, Inagi (JP); Hiroyuki Tanaka, Kawasaki (JP); Seiji Suzuki, Ebina (JP); Yoshiaki Suzuki, Nagareyama (JP); Yuji Kanome, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 666 days.

This patent is subject to a terminal disclaimer.

(21) Appl. No.: 12/896,703

(22) Filed: Oct. 1, 2010

(65) Prior Publication Data

US 2011/0109689 A1 May 12, 2011

(30) Foreign Application Priority Data

Nov. 6, 2009 (JP) ..... 2009-255227

(51) Int. Cl.
*B41J 2/165* (2006.01)
*B41J 2/17* (2006.01)
*B41J 29/377* (2006.01)

(52) U.S. Cl.
CPC ..... *B41J 29/377* (2013.01); *B41J 2/1714* (2013.01); *B41J 2/165* (2013.01)
USPC ..... 347/22; 347/25

(58) Field of Classification Search
USPC ..... 347/22, 25
See application file for complete search history.

(56) References Cited

U.S. PATENT DOCUMENTS

| | | | | |
|---|---|---|---|---|
| 5,806,992 | A * | 9/1998 | Ju | 400/56 |
| 8,454,118 | B2 * | 6/2013 | Kida et al. | 347/22 |
| 2005/0001881 | A1 * | 1/2005 | Nakashima et al. | 347/50 |
| 2008/0056788 | A1 * | 3/2008 | Okutsu | 399/372 |
| 2008/0246822 | A1 * | 10/2008 | Hara | 347/84 |

FOREIGN PATENT DOCUMENTS

| | | | |
|---|---|---|---|
| JP | 2003-103773 | A | 4/2003 |
| JP | 2005-271314 | A | 10/2005 |
| JP | 2006-44021 | A | 2/2006 |

* cited by examiner

*Primary Examiner* — Justin Seo
(74) *Attorney, Agent, or Firm* — Canon USA, Inc. IP Division

(57) ABSTRACT

An apparatus includes a supply unit having a humidifying portion that supplies humidified gas near a nozzle array of a line-type recording head. In correspondence to displacement of the recording head in a direction of the nozzle array, at least one of an introducing direction and an introducing position of the supplied humidified gas can be changed.

20 Claims, 12 Drawing Sheets

RECORDING APPARATUS

BACKGROUND OF THE INVENTION

1. Field of the Invention

The present invention relates to an inkjet recording apparatus using a line-type recording head.

2. Description of the Related Art

A line-type inkjet recording apparatus uses a line-type recording head in which a nozzle array extends over the entire width of a recording region. In a nozzle that is not frequently used in the nozzle array, a volatile component of ink evaporates, and this increases the ink viscosity. If the increase in ink viscosity further continues, there may be a risk that the nozzle cannot discharge ink.

To overcome this problem, attempts have been made to suppress evaporation of the volatile component of ink by supplying humidified gas near the nozzles in the recording head for the purpose of moisture retention. For example, Japanese Patent Laid-Open No. 2006-44021 (Patent Document 1) discloses a recording apparatus having a structure for supplying humidified gas into a gap between a recording head and a sheet.

To reduce the unevenness in use frequency of nozzles included in a nozzle array of a line-type recording head so that the total durability of the nozzles increases, it is effective to move the recording head relative to a sheet in the extending direction of the nozzle array at regular intervals.

When the nozzle array is moved, the position of the nozzle array relative to a flow of humidified gas changes, and this may hinder proper humidification at ends of the nozzle array. However, if a large amount of humidified gas is supplied to a wide area in consideration of the movement of the nozzle array, waste increases and the use efficiency of the humidified gas decreases. Patent Document 1 described above does not take this problem into consideration.

SUMMARY OF THE INVENTION

An apparatus according to an aspect of the present invention includes a conveying mechanism configured to convey a sheet in a first direction; a recording head having a nozzle array extending in a second direction intersecting the first direction, the recording head opposing the conveyed sheet with a gap being disposed therebetween; a displacement mechanism configured to displace the recording head in the second direction; and a supply unit configured to supply humidified gas near the nozzle array. At least one of an introducing direction and an introducing position of the supplied humidified gas is changed in correspondence to displacement of the recording head.

Further features of the present invention will become apparent from the following description of exemplary embodiments with reference to the attached drawings.

DESCRIPTION OF THE EMBODIMENTS

Figure 1:
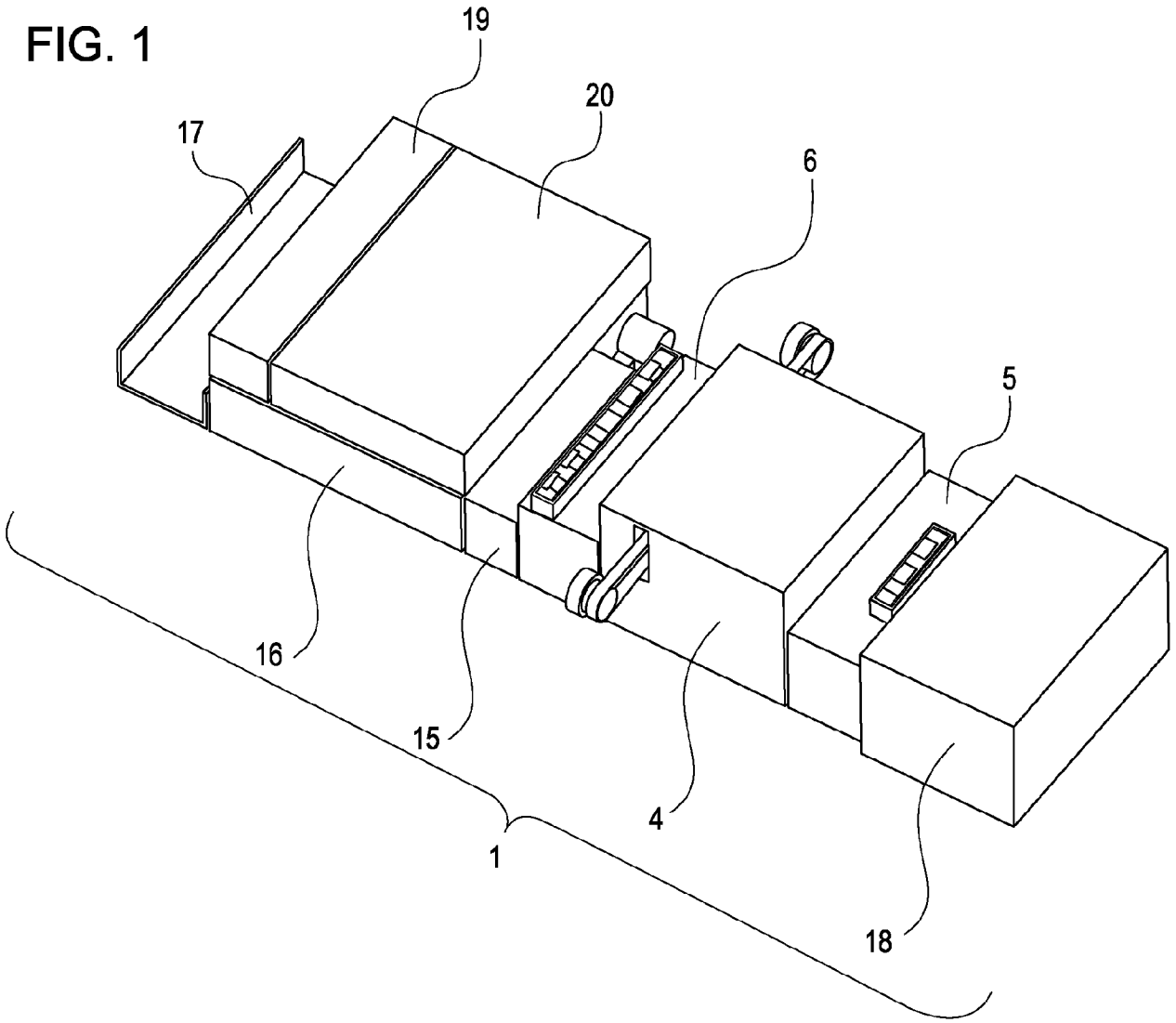
FIG. 1 is an overall perspective view of a recording apparatus according to a first embodiment.

FIG. 1 is a perspective view illustrating an overall configuration of a recording apparatus 1 according to a first embodiment of the present invention. Referring to FIG. 1, the recording apparatus 1 includes a paper feed unit 18, a supply unit 5, a recording unit 4, a recovery unit 6, a cutter unit 15, a dry unit 16, an ink tank unit 20, a control unit 19, and an output unit 17, which are arranged in order from an upstream side to a downstream side in a conveying direction of a sheet during recording.

Figure 2:
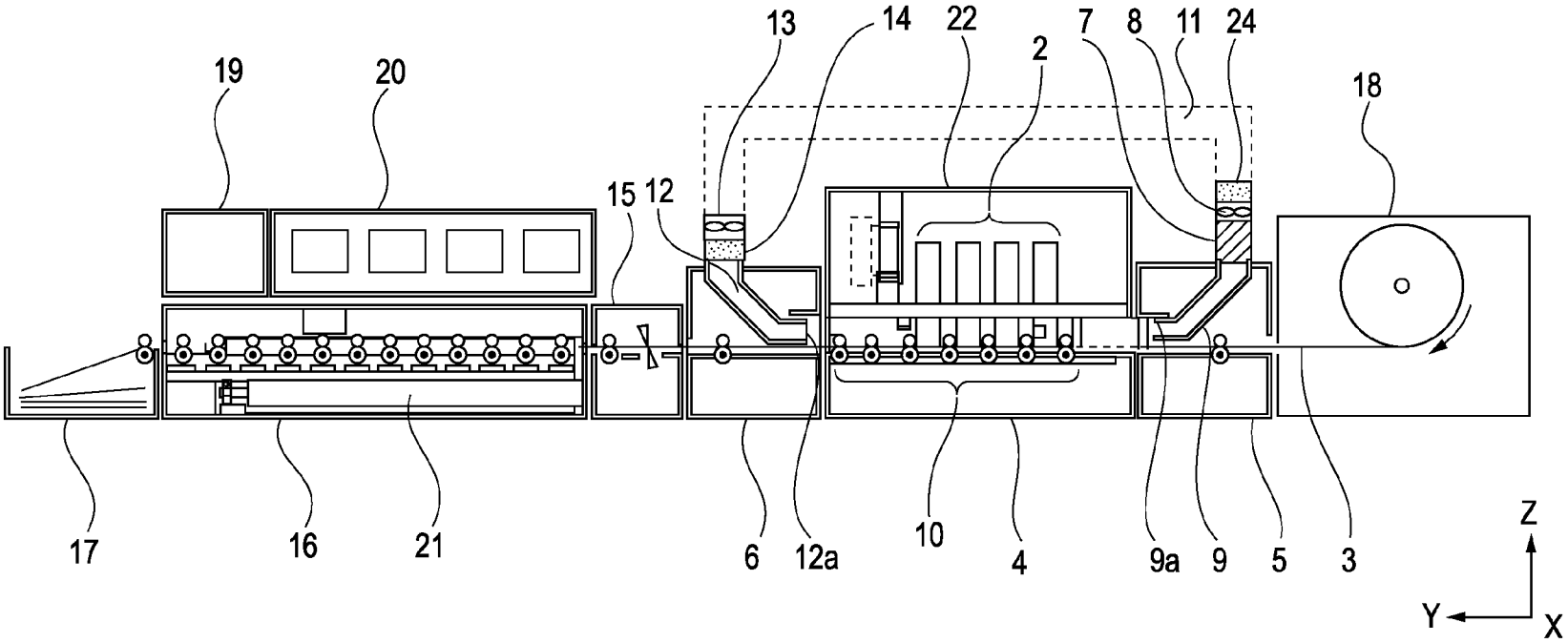
FIG. 2 is a cross-sectional view illustrating the internal configuration of the recording apparatus.

FIG. 2 is a cross-sectional view illustrating an internal configuration of the recording apparatus 1 of FIG. 1. The paper feed unit 18 rotatably holds a rolled sheet 3 serving as a recording medium. While the sheet 3 is a continuous sheet in the first embodiment, a cut sheet may be used alternatively. The paper feed unit 18 has a feeding mechanism that pulls out and supplies the sheet 3 downstream in a sheet conveying direction (a Y-direction, a first direction).

The recording unit 4 includes a plurality of recording heads 2 corresponding to different ink colors. While four recording heads are provided in correspondence to four colors C, M, Y, and K in the first embodiment, the number of colors is not limited to four. Inks of the different colors are supplied from the ink tank unit 20 to the corresponding recording heads 2 through ink tubes. The recording heads 2 are formed by line-type recording heads respectively including nozzle arrays. The nozzle arrays use an inkjet method, and are provided in a region that covers the largest possible width of sheets to be used. The nozzle arrays extend in a direction (an X-direction, a second direction) intersecting the first direction (at right angles in the embodiment). In the nozzle arrays, nozzle chips serving as units may be arranged in a regular arrangement form, such as a staggered manner, over the entire width, or may be arranged in a line over the entire width. The inkjet method can use, for example, heating elements, piezoelectric elements, electrostatic elements, or MEMS elements.

In the recording unit 4, a sheet conveying path extends opposed to the recording heads 2, and a conveying mechanism 10 is provided to convey the sheet 3 along the sheet conveying path. The conveying mechanism 10 includes a plurality of conveying rollers arranged along the sheet conveying path and a platen 109 having a support surface on which the sheet 3 is supported between the adjacent conveying rollers. The recording heads 2, the conveying mechanism 10, and the platen 109 are stored in a housing 22. As described above, there are two different regions, that is, a region where the conveyed sheet 3 faces the nozzle arrays of the recording heads (conveying region) and a region where the conveyed sheet 3 does not face the nozzle arrays (non-conveying region). The relationship and ratio between the conveying region and the non-conveying region change in accordance with the size of the sheet to be used.

Humidified gas generated by the supply unit 5 is supplied into the recording unit 4. Although air is used as the gas in the first embodiment, other gases can be used instead. The humidified gas supplied to the recording unit 4 is recovered by the recovery unit 6. At least part of the humidified gas recovered by the recovery unit 6 is returned to the supply unit 5 for reuse through a return duct 11. In the recording unit 4, a humidity sensor (not shown) for measuring the gas humidity is provided near the nozzle arrays of the recording heads 2.

The supply unit 5 generates humidified gas and supplies the generated humidified gas near the nozzle arrays of the recording head 2. The supply unit 5 mainly includes a supply duct 9, a humidifying portion 7, a fan 8, and a filter 24. Some of the conveying rollers in the conveying mechanism 10 are provided below the supply duct 9, and the sheet conveying path passes between the conveying rollers. An end of the supply duct 9 serves as a supply port 9*a* from which humidified gas is ejected. The supply port 9*a* is oriented so as to eject the humidified gas into a gap between the recording heads 2 in the recording unit 4 and the sheet 3 or the support surface of the platen 109 facing the recording heads 2 from the upstream side to the downstream side in the conveying direction. The supplied humidified gas mainly flows through the gap in the sheet conveying direction. As will be described below, the supply unit 5 can change the flow-rate distribution of the supplied humidified gas in the second direction.

Figure 3:
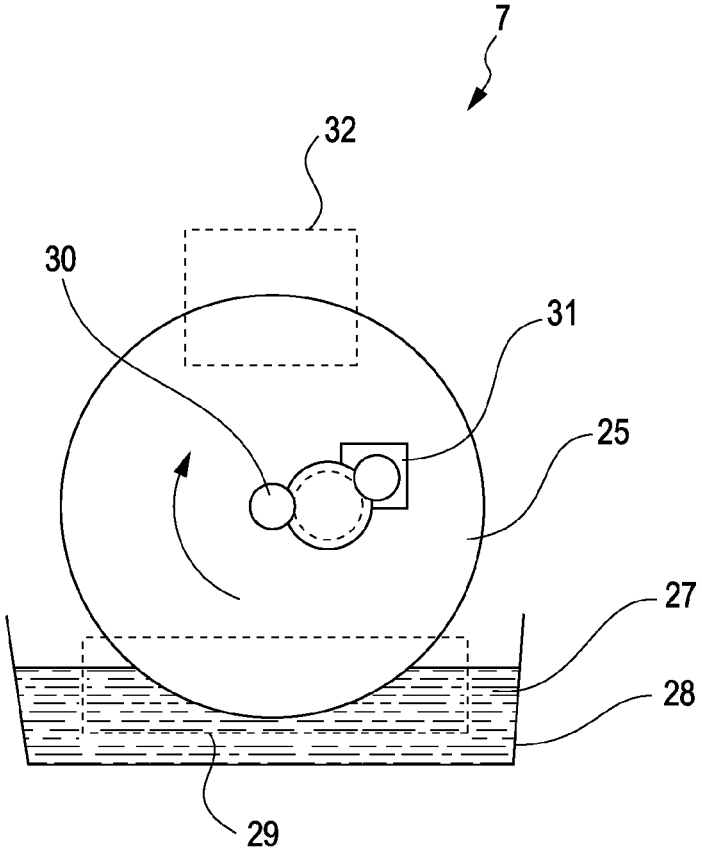
FIG. 3 is a schematic view of a humidifying portion.

The humidifying portion 7 generates humidified gas by vaporization. FIG. 3 is a schematic view illustrating the structure of the humidifying portion 7. The humidifying portion 7 includes a disk 25 which is formed by a highly absorbent member or to which a highly absorbent member is attached. The disk 25 is rotated on a shaft 30 by a driving mechanism 31. At a position 29, a lower portion of the disk 25 is in contact with water 27 stored in a tank 28. With rotation of the disk 25, the entire absorbent member gradually absorbs the water 27. Clean gas from which dust and foreign substances are removed by the filter 24 in the supply unit 5 is introduced into the humidifying portion 7 by the fan 8. The introduced gas passes while touching a part of the rotating disk 25 at a position 32. Hence, part of water in the absorbent member is converted into gas, thereby generating humidified gas. The humidifying ability of the humidifying portion 7 can be adjusted by the rotation speeds of the disk 25 and the fan 8. The control unit 19 performs feedback control on the basis of the detection result of the humidity sensor so as to generate humidified gas having an appropriate humidity.

The humidifying portion 7 is not limited to the one of the first embodiment, and may be other known types such as an evaporative type, a water spray type, and a steam type. The evaporative type includes a moisture permeable membrane type, a drop flow-through type, and a capillary type in addition to the rotary type adopted in the first embodiment. The water spray type includes an ultrasonic type, a centrifugal type, a high-pressure spray type, and a dual-fluid spray type. The steam type includes a steam pipe type, a thermoelectric type, and an electrode type.

The humidified gas generated by the humidifying portion 7 is ejected as an airflow from the supply port 9*a* through the supply duct 9. The ejected humidified gas is supplied to a position near a nozzle surface of the most upstream recording head of a plurality of recording heads 2. The supplied humidified gas mainly flows from the upstream side to the downstream side in the first direction and passes through the gaps between the nozzle arrays of the recording heads and the sheet 3 or the platen surface in order. In other words, the humidified gas is supplied from the upstream side in the conveying direction, and flows to the downstream side in the conveying direction through the gaps between the nozzle arrays of the recording heads and the sheet. Since the tips of the nozzles are moisturized by the humidified gas, evaporation and drying of the ink in the nozzles are suppressed.

The recovery unit 6 recovers the humidified gas supplied to the recording unit 4. The recovery unit 6 mainly includes a recovery duct 12, a fan 13, and a filter 14. Some of the conveying rollers in the conveying mechanism 10 are provided below the recovery duct 12, and the sheet conveying path passes between the conveying rollers. An end of the recovery duct 12 serves as a recovery port 12*a* from which the humidified gas is sucked. The recovery port 12*a* is provided at a position such as to suck the humidified gas that has flown between the recording head 12 and the opposing sheet 3 or platen support surface and passed by the most downstream recording head 2.

Rotation of the fan 13 produces a sucking force for generating an airflow in the recovery duct 12. The filter 14 mainly removes ink mist. The recovery duct 12 is connected to the return duct 11 via the fan 13, and the return duct 11 is connected to the humidifying portion 7 and the supply duct 9 via the filter 24. That is, the humidified gas recovered from the recording unit 4 is returned to the supply unit 5 for reuse through a return passage formed by the return duct 11. Since the gas introduced in the humidifying portion 7 for reuse originally has a relatively high humidity, the total humidification efficiency of the apparatus is enhanced. Alternatively, part of the humidified gas recovered from the recovery duct 12 may be returned for reuse, and the other part may be discharged into the interior of the recording apparatus 1. If the humidity of the humidified gas is decreased to a value equivalent to the humidity in the recording apparatus 1 when the humidified gas is recovered by the recovery duct 12, a great enhancement of humidification efficiency cannot be expected. Hence, the return duct 11 used to reuse the humidified gas may be omitted.

The cutter unit 15 includes a cutter mechanism, and cuts the continuous sheet to a predetermined size after recording is performed on the continuous sheet by the recording unit 4. The dry unit 16 dries the ink on cut sheets in a short time, and includes a heater 21 and a plurality of conveying rollers arranged along the conveying path. The output unit 17 receives cut sheets output from the dry unit 16, and a plurality of sheets are stacked in the output unit 17. The control unit 19 is a controller that performs various control operations over the entire recording apparatus 1 and controls driving, and includes a CPU, a memory, and various I/O interfaces.

Figure 4:
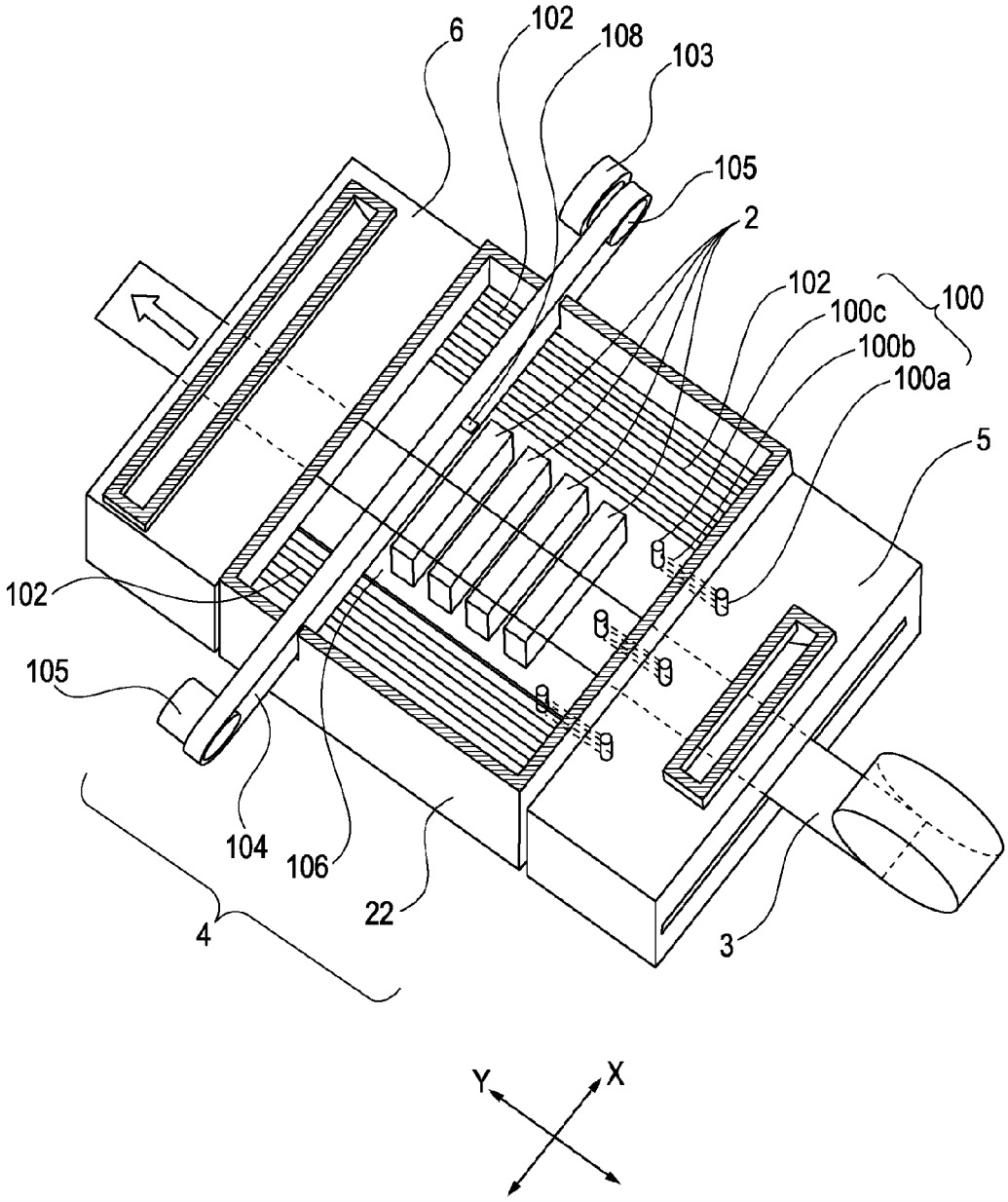
FIG. 4 is a perspective view illustrating structures of a recording unit, a supply unit, and a recovery unit.
Figure 5:
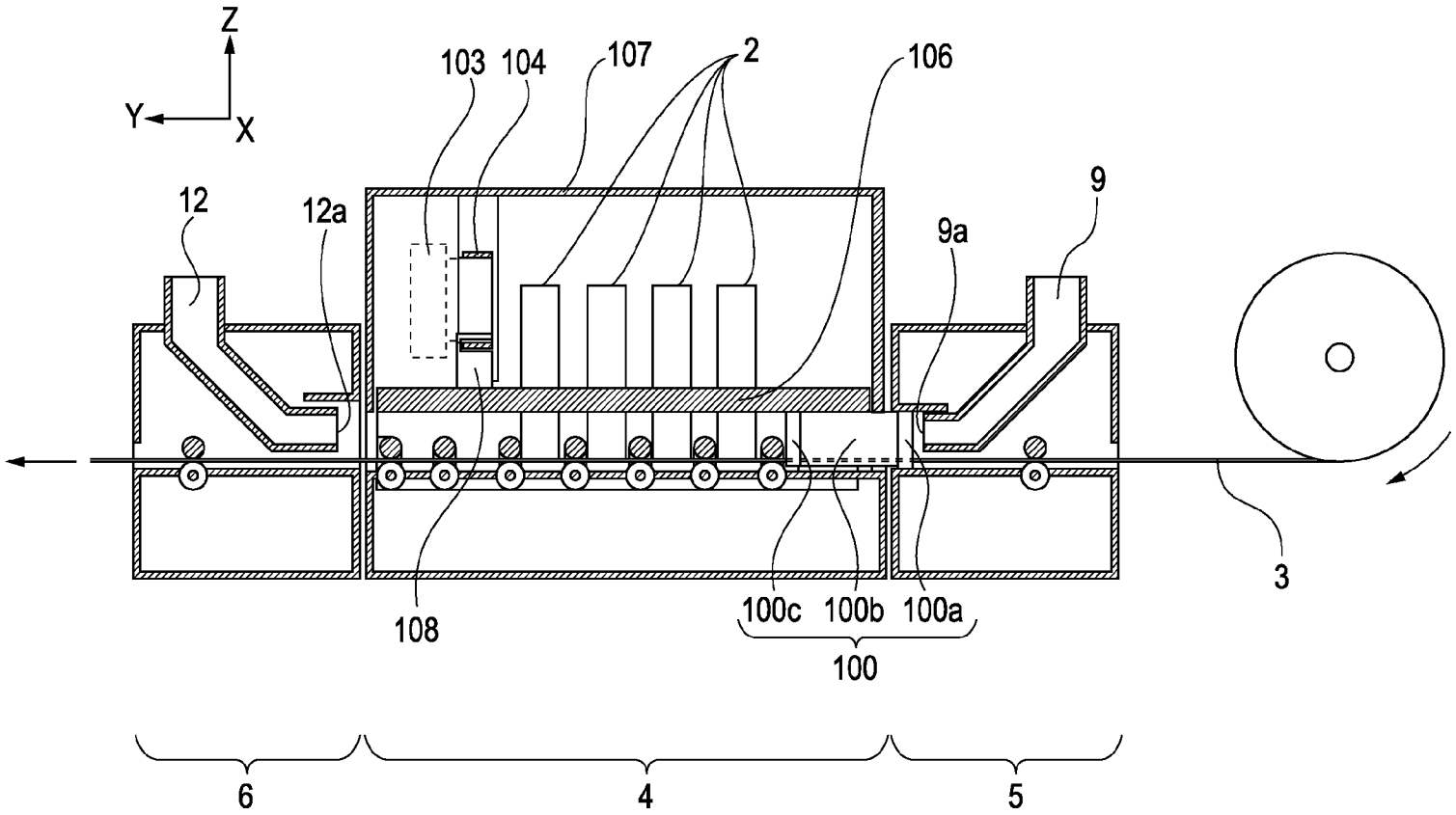
FIG. 5 is a sectional view of the recording unit, the supply unit, and the recovery unit illustrated in FIG. 4, as viewed in a second direction.
Figure 6:
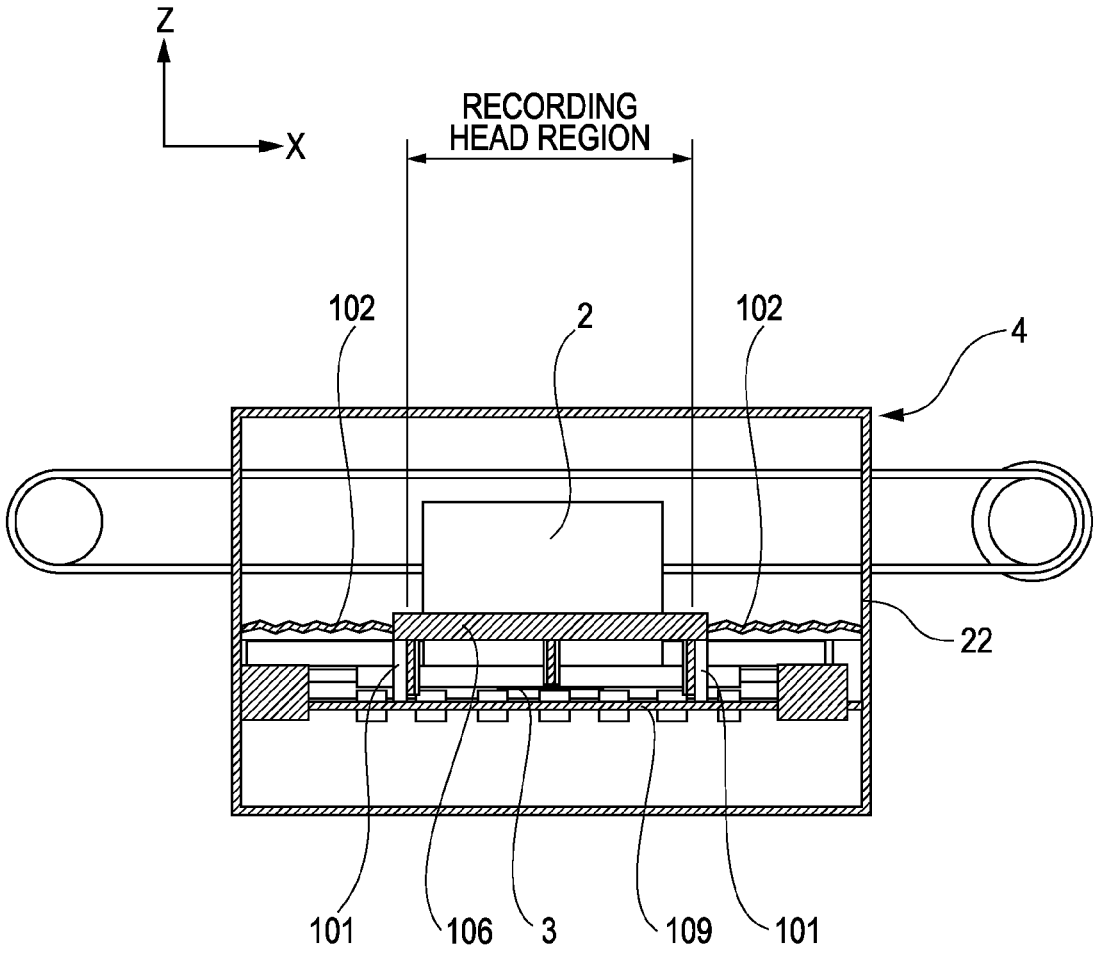
FIG. 6 is a sectional view of the recording unit, as viewed in a first direction.

FIG. 4 is a perspective view illustrating detailed structures of the recording unit 4, the supply unit 5, and the recovery unit 6 in the recording apparatus 1. FIG. 5 is a sectional view of the same structures, as viewed in the second direction. FIG. 6 is a sectional view of the recording unit 4, as viewed in the first direction. In the housing 22 of the recording unit 4, an enclosed space that is enclosed, except for an entrance port and an exit port of the sheet conveying path, is provided. A plurality of recording heads 2 are held together by a holder 106 in the enclosed space of the housing 22.

To reduce the unevenness in use frequency of the nozzle arrays of the recording heads 2, the holder 106 is movable in the second direction or an angular direction close to the second direction. For that purpose, the holder 106 is provided with a displacement mechanism (first displacement mechanism) including a pulse motor 103, a belt 104, and pulleys 105. The holder 106 is fixed to the belt 104 at an attachment portion 108. The pulse motor 103 drives the pulleys 105 attached to the belt 104. To reduce the unevenness in use frequency of the nozzles, the control unit 19 periodically changes the nozzles to be used for the sheet by driving the pulse motor 103 to move the recording heads 2, on the basis of the accumulated number of discharging operations or accumulated use time of the nozzles in the nozzle arrays. The holder 106 can also be displaced by another displacement mechanism (second displacement mechanism) in the up-down direction (Z-direction, third direction) in which the recording heads 2 face the sheet 3. When the holder 106 is displaced in the third direction, the recording heads 2 move to different height positions during recording operation and during maintenance operation (e.g., preliminary discharging, wiping of the nozzles, and capping for suppression of dry of the nozzles).

Sealing covers 102 formed of a flexible material are provided between both side faces of the holder 106 and two inner side faces of the housing 22. The sealing covers 102 further form, in the housing 22, a chamber structure having a chamber space. The chamber structure includes parts of the recording heads 2 including at least the nozzle arrays and at least part of the conveying mechanism 10 facing the nozzle arrays. The sealing covers 102 are also formed of a moisture-proof material that does not let water through. For example, the sealing covers 102 have a bellows-shaped structure such as to flexibly deform in the second direction and the third direction, and can deform to follow the displacement of the holder 106 in the second direction and the third direction. That is, with the displacement of the recording heads 2, part of the chamber structure deforms while substantially maintaining airtightness. Although the chamber space in the chamber structure is not completely airtight in the first direction because of the presence of openings, it is kept substantially airtight to an extent such that the humidity does not greatly change in a short time.

Figure 7A:
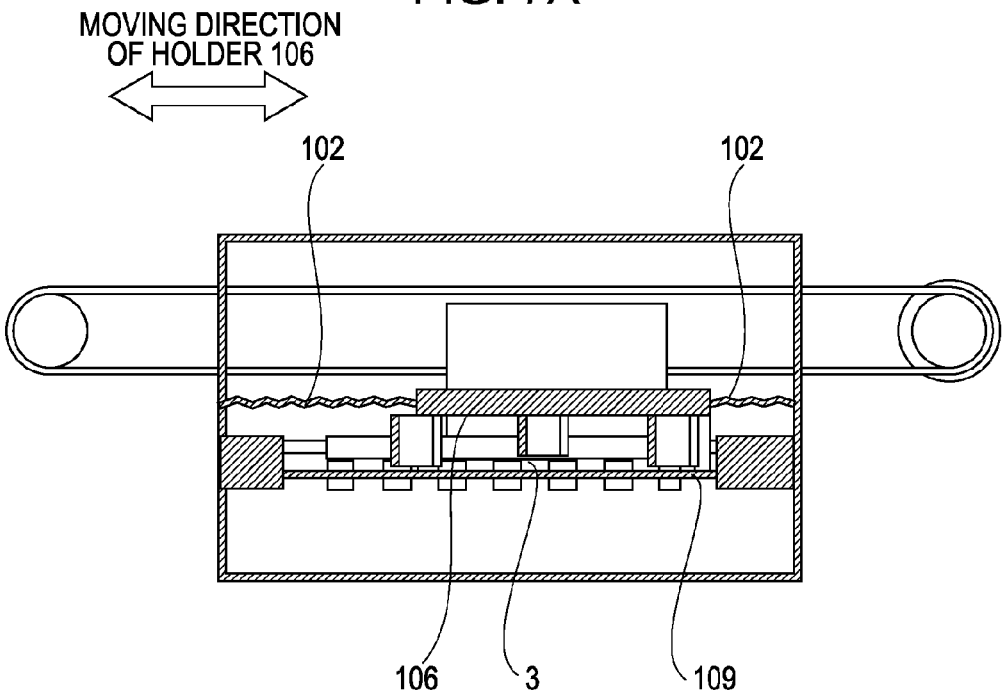
FIGS. 7A and 7B are sectional views illustrating states of the recording unit when a holder is moved.
Figure 7B:
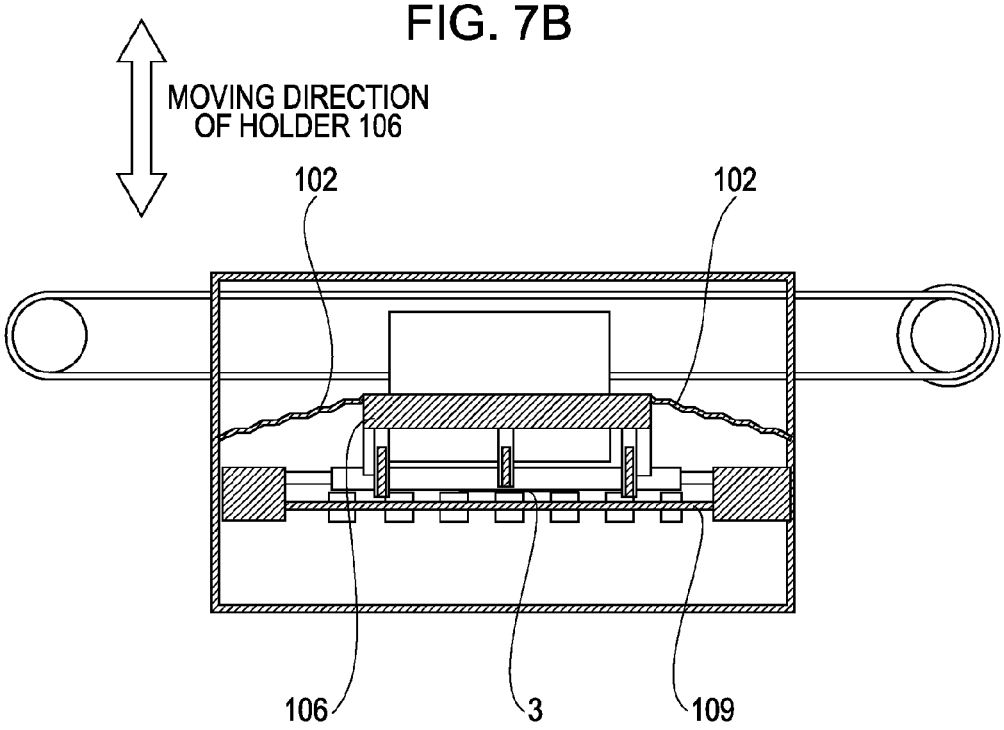

FIGS. 7A and 7B are sectional views illustrating states of the recording unit 4 provided when the holder 106 is moved. FIG. 7A illustrates a state in which the sealing covers 102 deform when the holder 106 moves in the second direction. FIG. 7B illustrates a state in which the sealing covers 102 deform when the holder 106 moves in the third direction. Whether the holder 106 moves in the second direction or the third direction, the sealing covers 102 deform while being kept substantially airtight, so that the chamber space is kept substantially airtight.

As illustrated in FIG. 6, shielding plates 101 are attached to both sides of the holder 106 along the first direction. Bottoms of the shielding plates 101 face the platen 109 in a non-contact manner such that a small gap is provided therebetween. A lower surface of the holder 106, the shielding plates 101, and the support surface of the platen 109 form a substantially enclosed flowing space. In the flowing space, supplied humidified gas efficiently flows in the first direction through a narrow space limited to the width region of the recording heads 2 (recording head region).

In FIGS. 4 and 5, a flow adjusting mechanism 100 can change at least one of an introducing direction and an introducing position in the second direction of the supplied humidified gas in accordance with the displacement of the recording heads 2 in the second direction. The introducing direction and/or the introducing position are changed to follow the displacement of the recording heads in the second direction performed by the displacement mechanism so that a larger amount of humidified gas is supplied to a region where the recording heads are provided. The flow adjusting mechanism 100 has a movable louver structure including a plurality of (three in the embodiment) flappers that can interlock to change the angle. The flappers are arranged in the second direction near the supply port 9*a* of the supply duct 9 in a space between the holder 106 and the platen 109 in a manner such as not to touch the conveyed sheet 3. Humidified gas ejected from the supply port 9*a* passes between the flappers and is then introduced into the flowing space provided in the recording unit 4.

Figure 8:
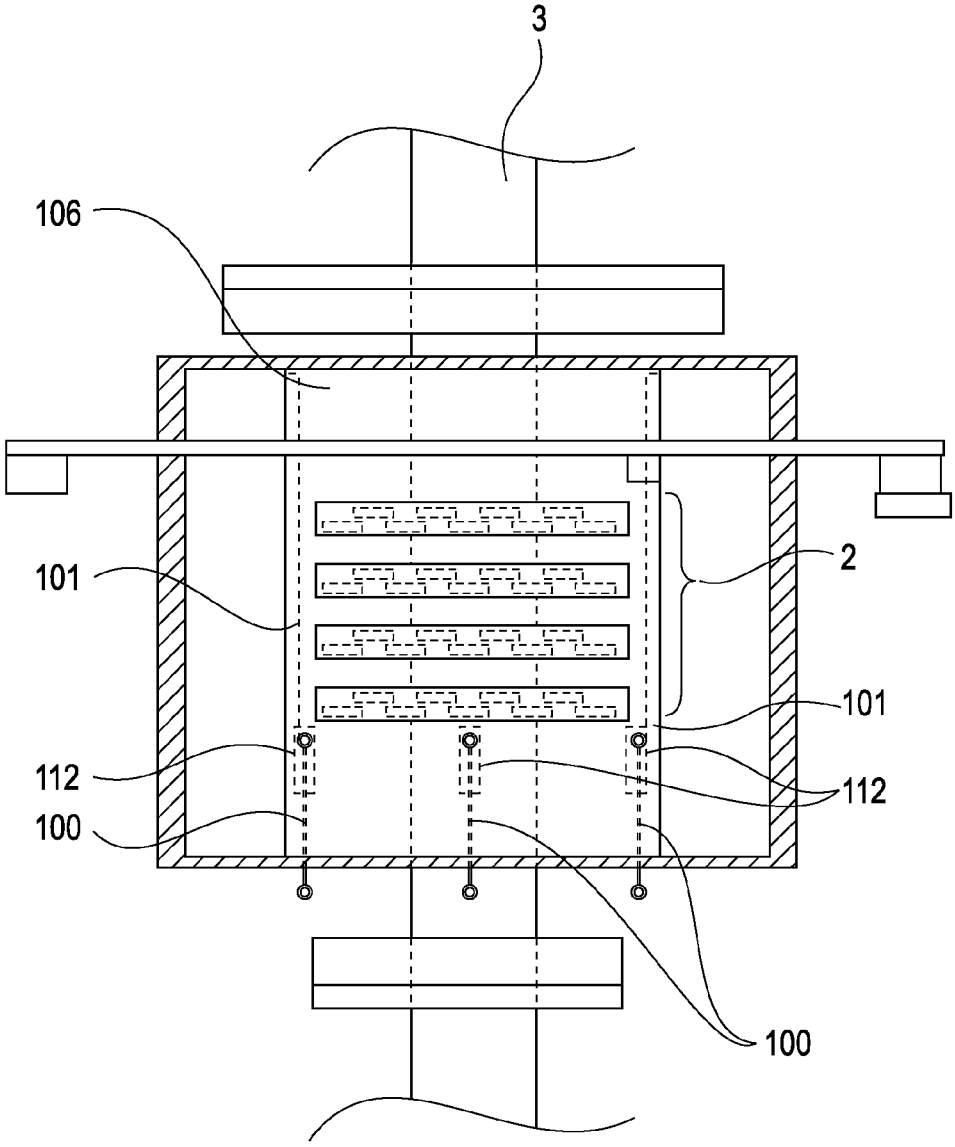
FIG. 8 illustrates a support structure for flappers.

In each of the flappers, a blade 100*b* shaped like a flat plate is connected between a support shaft 100*a* and a support shaft 100*c*, and the blade 100*b* can turn on the support shaft 100*a* and the support shaft 100*c*. While the blade 100*b* is formed of stainless steel in the first embodiment, it may be formed of any other material as long as the material does not cause property change due to humidification and has a sufficient rigidity to withstand air pressure. The support shaft 100*a* is attached to a housing of the supply unit 5, and the support shaft 100*c* is supported by the holder 106 in the recording unit 4. Therefore, part of the blade 100*b* is located in the supply unit 5, and the other part is located in the recording unit 4. As illustrated in FIG. 8, the support shaft 100*c* is supported by the holder 106 in a manner such as to be movable along a groove 112 provided in the first direction in the lower surface of the holder 106. When the holder 106 moves in the second direction, the support shaft 100*c* also moves in the second direction, thereby changing the angle of the blade 100*b* of the flapper. In this case, the support shaft 100*c* moves along the groove 112.

Figure 9:
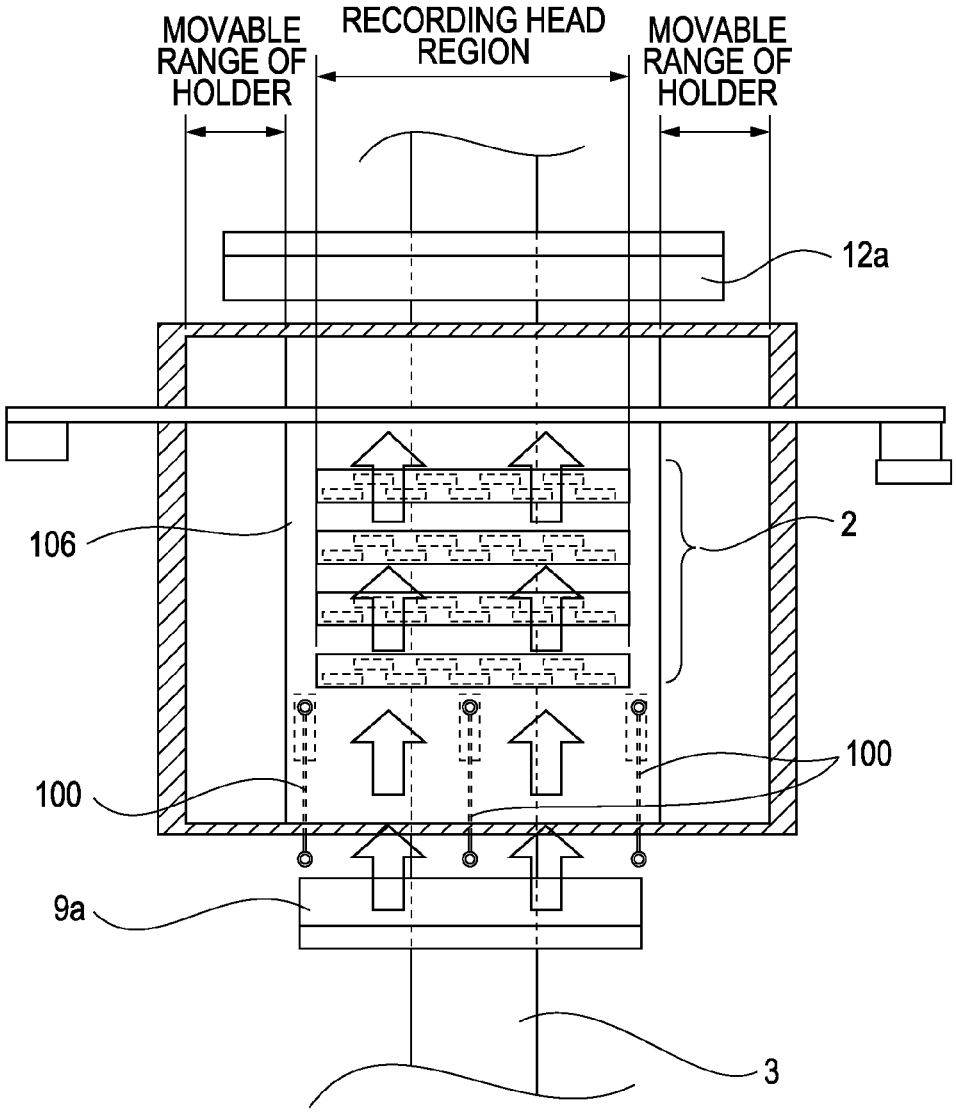
FIG. 9 illustrates a state of a flow adjusting mechanism when the holder is at the center in the second direction.

FIG. 9 illustrates a state of the flow adjusting mechanism 100 provided when the holder 106 is at the center in the second direction. FIG. 9 illustrates the relationship between the recording head region and the movable range of the holder 106. It is only necessary to supply humidified gas to the region limited to the recording head region, regardless of movement of the holder 106. The flappers in the flow adjusting mechanism 100 point in a direction parallel to the first direction. Humidified gas from the supply port 9*a* is supplied to the region substantially limited to the recording head region. As shown by the arrows in FIG. 9, the humidified gas supplied from the supply port 9*a* flows to the nozzle array of the most upstream recording head in the first direction. After that, the humidified gas also flows from the upstream side to the downstream side in the first direction and through the gap between the nozzle arrays of the recording heads corresponding to the colors and the sheet 3 or the platen surface. Thus, the humidified gas is properly supplied to the entire nozzle arrays to moisturize the nozzle arrays. This suppresses evaporation of ink in the nozzles, and enhances the utilization efficiency of the humidified gas.

Figure 10:
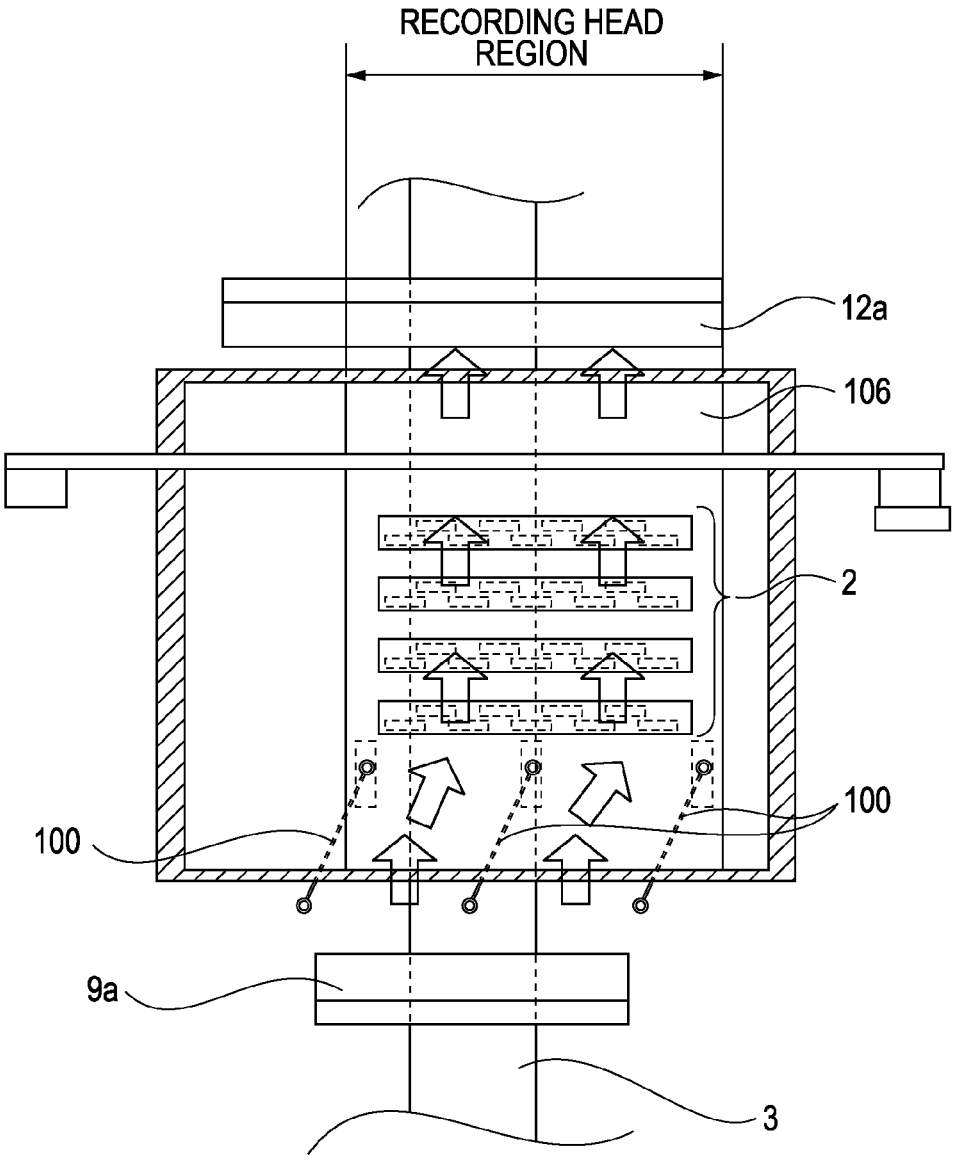
FIG. 10 illustrates a state of the flow adjusting mechanism when the holder is moved to an end in the second direction.

FIG. 10 illustrates a state of the flow adjusting mechanism 100 provided when the holder 106 is moved to an end in the second direction. The three flappers tilt toward the moved recording heads 2 at the same angle to the first direction. In accordance with the displacement of the recording heads 2 in the second direction, the introducing direction and the introducing positions of the supplied humidified gas in the second direction change as compared to the case illustrated in FIG. 9. For this reason, the humidified gas from the supply port 9*a* is supplied to the region substantially limited to the recording head region. As shown by the arrows in FIG. 10, the humidified gas from the supply port 9*a* flows obliquely with respect to the first direction to the nozzle array of the most upstream recording head. After that, the humidified gas mainly flows from the upstream side to the downstream side in the first direction and through the gap between the nozzle arrays of the recording heads corresponding to the colors and the sheet 3 or the platen surface. Thus, the humidified gas is properly supplied to the entire nozzle arrays to moisturize the nozzle arrays. This suppresses evaporation of ink in the nozzles and enhances the utilization efficiency of the humidified gas.

Figure 11A:
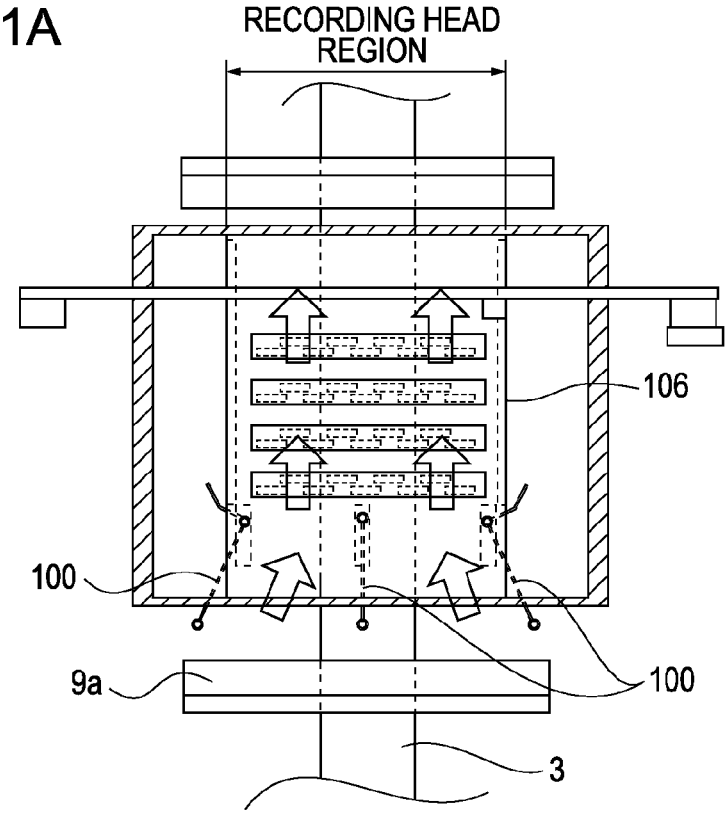
FIGS. 11A and 11B illustrate a structure of a flow adjusting mechanism according to a second embodiment.
Figure 11B:
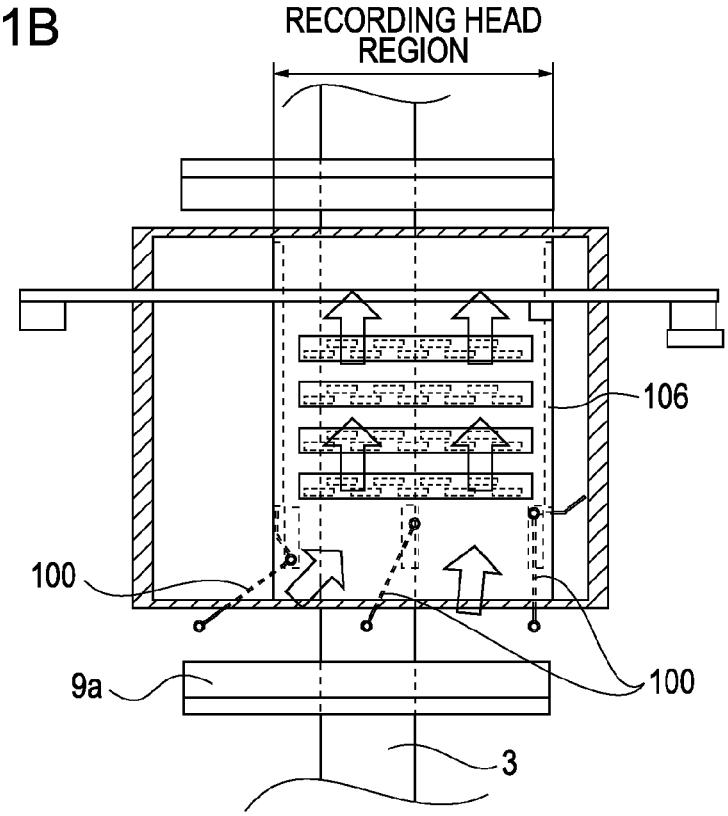

FIGS. 11A and 11B illustrate the structure of a flow adjusting mechanism 100 according to a second embodiment of the present invention. The second embodiment is different from the first embodiment in that a plurality of flappers are not provided in parallel. FIGS. 11A and 11B illustrate states of the flow adjusting mechanism 100, respectively, when a holder 106 is at the center in the second direction and when the holder 106 is moved to an end in the second direction. In both cases, humidified gas supplied from a supply port 9*a* is supplied to a region substantially limited to a recording head region, regardless of displacement of recording heads in the second direction. Flaps at both ends, of three flaps, do not point in a direction parallel to the center flap, but point inward. For this reason, the size of the supply port 9*a* can be increased, and this allows supply of a large amount of humidified gas.

Figure 12A:
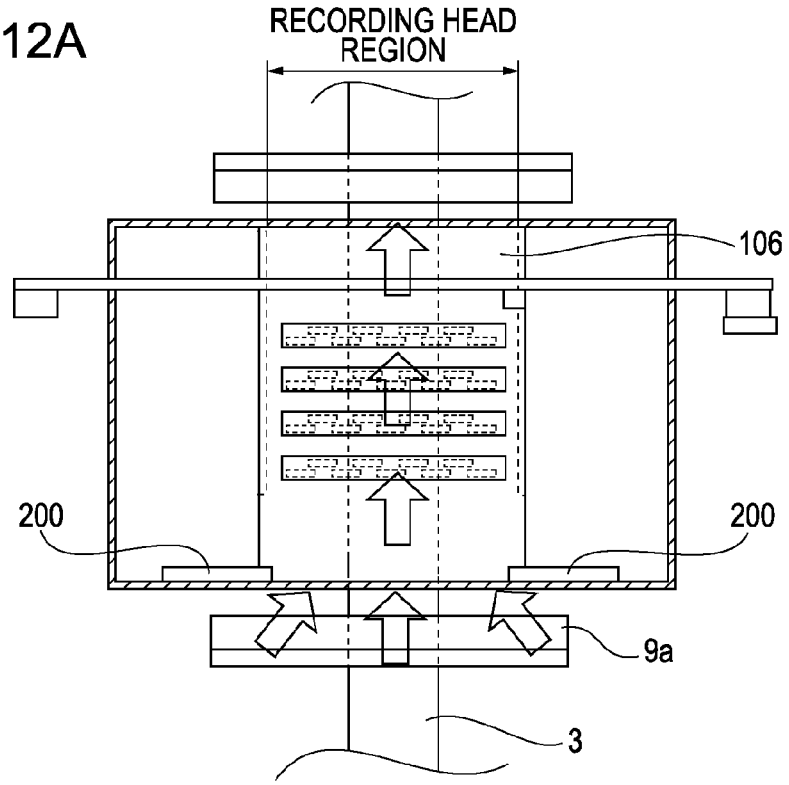
FIGS. 12A and 12B illustrate a structure of a flow adjusting mechanism according to a third embodiment.
Figure 12B:
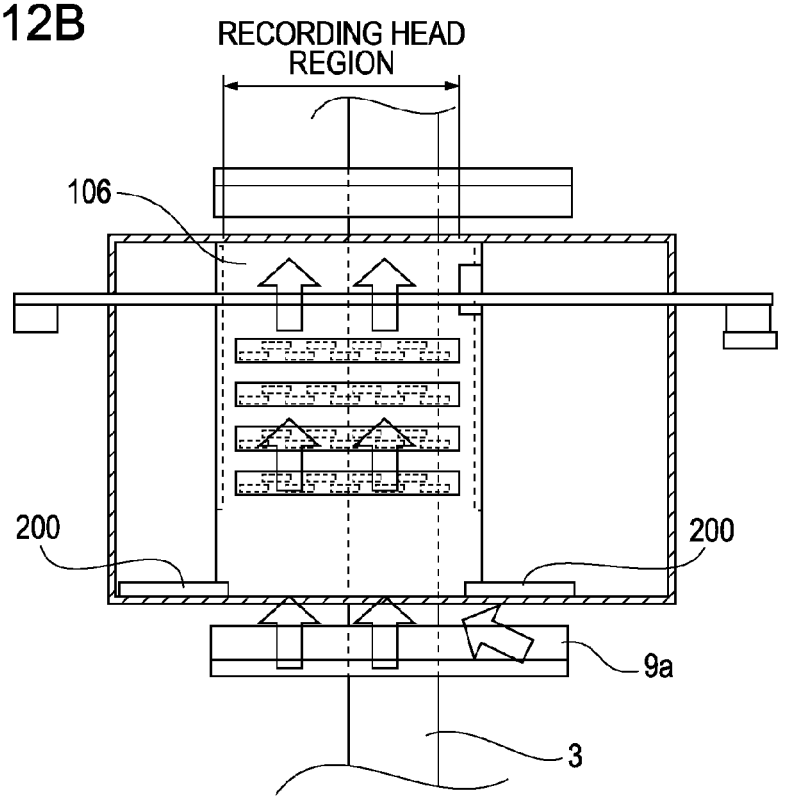

FIGS. 12A and 12B illustrate the structure of a flow adjusting mechanism 100 according to a third embodiment of the present invention. The third embodiment does not adopt the louver mechanism adopted in the above embodiments, but adopts a shutter 200 having a limited opening from which airflows are introduced. Near a supply port 9*a* of a supply duct 9, the shutter 200 is provided to pass the airflows only through a limited region corresponding to a recording head region and to block the airflows in the other unnecessary region. The shutter 200 is attached to a holder 106, and, when the holder 106 moves in a second direction, the shutter 200 also moves in the second direction. That is, the position of the opening of the shutter 200 (the introducing position) moves with displacement of recording heads 2 in the second direction, and humidified gas is introduced through the opening. FIG. 12A illustrates a state of the shutter 200 when the holder 106 is at the center in the second direction, and FIG. 12B illustrates a state of the shutter 200 when the holder 106 is moved to an end in the second direction. Regardless of the position to which the holder 106 moves, the shutter 200 provides the air introducing opening at the position corresponding to the recording heads. Humidified gas ejected from the supply port 9*a* flows through the opening of the shutter 200, and is introduced into a flowing space provided in a recording unit 4. A bellows (not shown) is provided between the supply port 9*a* and the shutter 200 so as to prevent a leakage of the introduced humidified gas regardless of the movement of the shutter 200.

According to the above-described embodiments, humidified gas is supplied by the flow adjusting mechanism 100 only to the region substantially limited to the recording head region, where humidity retention is necessary, regardless of the displacement of the recording heads in the second direction. For this reason, the utilization efficiency of humidified gas is high, the entire nozzle arrays can be properly moisturized without enhancing the ability of the supply unit including the humidifying portion.

Since parts of the nozzle arrays of the recording heads are stored in the flexible structure, even when the recording heads are displaced in the second direction or the third direction, necessary airtightness is maintained, and this further enhances the utilization efficiency of humidified gas. Moreover, since the humidified gas is introduced from the supply unit into the narrow space formed by the lower surface of the holder, the shielding plates, and the part of the conveying mechanism and then flows in the first direction, the utilization efficiency of humidified gas is further enhanced. In addition, since there is provided the return path through which the humidified gas supplied near the nozzle arrays is returned for reuse, the utilization efficiency of humidified gas is enhanced further.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-255227 filed Nov. 6, 2009, which is hereby incorporated by reference herein in its entirety.

What is claimed is:

1. An apparatus comprising:

a conveying mechanism configured to convey a sheet in a first direction;

a recording head having a nozzle array extending in a second direction intersecting the first direction, the recording head opposing the conveyed sheet with a gap being disposed therebetween;

a displacement mechanism configured to displace the recording head at least in the second direction;

a supply unit configured to supply humidified gas near the nozzle array; and a chamber structure, configured to provide a space, including the nozzle array and at least part of the conveying mechanism opposing the nozzle array, wherein at least one of an introducing direction and an introducing position of the supplied humidified gas to the nozzle array is changed in correspondence to displacement of the recording head.

2. The apparatus according to claim 1, wherein at least one of the introducing direction and the introducing position is changed in correspondence to the displacement of the recording head so that an amount of the humidified gas is supplied to a region where the recording head is provided, and wherein the supplied humidified gas flows in the first direction and through the gap.

3. The apparatus according to claim 1, wherein the chamber structure is provided within the apparatus.

4. The apparatus according to claim 1, wherein the supply unit includes a humidifying portion configured to generate the humidified gas, and a duct configured to guide the generated humidified gas to the space in the chamber structure.

5. The apparatus according to claim 1, wherein part of the chamber structure deforms with the displacement of the recording head in the second direction.

6. The apparatus according to claim 5, further comprising:

a second displacement mechanism configured to displace the recording head in a third direction intersecting the first direction and the second direction, wherein the part of the chamber structure deforms with displacement of the recording head in the third direction.

7. The apparatus according to claim 5, wherein the part of the chamber structure is a flexible member that is attached to a holder configured to displace while holding the recording head and that deforms with displacement of the holder.

8. The apparatus according to claim 7, further comprising:

two shielding plates attached to the holder such that the recording head is provided between the shielding plates in the second direction, wherein the humidified gas is introduced in a space formed by a lower surface of the holder, the two shielding plates, and the part of the conveying mechanism, and flows in the first direction.

9. An apparatus comprising:

a conveying mechanism configured to convey a sheet in a first direction;

a recording head having a nozzle array extending in a second direction intersecting the first direction, the recording head opposing the conveyed sheet with a gap being disposed therebetween;

a displacement mechanism configured to displace the recording head at least in the second direction; and a supply unit configured to supply humidified gas near the nozzle array, wherein at least one of an introducing direction and an introducing position of the supplied humidified gas to the nozzle array is changed in correspondence to displacement of the recording head, and, wherein the supply unit includes a flow adjusting mechanism having a flapper, and changes a direction of a flow of the humidified gas by changing an orientation of the flapper in correspondence to the displacement of the recording head performed by the displacement mechanism.

10. The apparatus according to claim 1, wherein the supply unit includes a shutter having an opening whose position moves with the displacement of the recording head in the second direction, and the humidified gas is introduced through the opening of the shutter.

11. An apparatus comprising:

a conveying mechanism configured to convey a sheet in a first direction;

a recording head having a nozzle array extending in a second direction intersecting the first direction, the recording head opposing the conveyed sheet with a gap being disposed therebetween;

a displacement mechanism configured to displace the recording head at least in the second direction; and a supply unit configured to supply humidified gas near the nozzle array, wherein at least one of an introducing direction and an introducing position of the supplied humidified gas to the nozzle array is changed in correspondence to displacement of the recording head, and wherein a plurality of the recording heads are arranged in the first direction, and the humidified gas is supplied from an upstream side of the recording heads and flows downstream near the nozzle arrays.

12. The apparatus according to claim 11, further comprising:

a path through which the humidified gas supplied near the nozzle array returns to the supply unit for reuse.

13. An apparatus comprising:

a conveying mechanism configured to convey a sheet in a first direction;

a recording head having a nozzle array extending in a second direction intersecting the first direction, the recording head opposing the conveyed sheet with a gap being disposed therebetween;

a holder configured to displace while holding the recording head;

a first displacement mechanism configured to displace the holder in the second direction;

a second displacement mechanism configured to displace the holder in a third direction intersecting the first direction and the second direction;

a chamber structure, configured to provide a space, including the nozzle array and at least part of the conveying mechanism opposing the nozzle array, the chamber structure having a flexible member that deforms with the displacement of the holder in the second direction or the third direction; and a supply unit configured to supply humidified gas into the space included in the chamber structure.

14. The apparatus according to claim 13, further comprising:

two shielding plates attached to the holder such that the recording head is provided between the shielding plates in the second direction, wherein the humidified gas is introduced in a space formed by a lower surface of the holder, the two shielding plates, and the part of the conveying mechanism, and flows in the first direction.

15. The apparatus according to claim 13, wherein a plurality of the recording heads are arranged in the first direction, and the humidified gas is supplied from an upstream side of the recording heads and flows downstream near the nozzle arrays of the recording heads.

16. The apparatus according to claim 13, further comprising:

a path through which the humidified gas supplied near the nozzle array returns to the supply unit for reuse.

17. The apparatus according to claim 1, wherein the recording head is a line-type inkjet head having the nozzle array for discharging ink, the nozzle array having a length larger than the sheet's width in the second direction.

18. The apparatus according to claim 17, wherein the sheet is a continuous sheet.

19. The apparatus according to claim 13, wherein the recording head is a line-type inkjet head having the nozzle array for discharging ink, the nozzle array having a length larger than the sheet's width in the second direction.

20. The apparatus according to claim 19, wherein the sheet is a continuous sheet.

* * * * *